United States Patent [19]

Friedland

[11] 4,307,590

[45] Dec. 29, 1981

[54] RECEPTACLES FOR KEYS

[76] Inventor: Samuel Friedland, 7 Spring Hill Dr., West Orange, N.J. 07092

[21] Appl. No.: 185,816

[22] Filed: Sep. 10, 1980

[51] Int. Cl.[3] ..... A47G 29/10

[52] U.S. Cl. ..... 70/456 R

[58] Field of Search ..... 150/40; 70/456 R; 206/37, 38

[56] References Cited

U.S. PATENT DOCUMENTS

| | | | |
|---|---|---|---|
| 1,934,889 | 11/1933 | Segal | 70/456 R |
| 2,564,918 | 8/1951 | Old | 70/456 R |
| 2,694,921 | 11/1954 | Kerner | 70/456 R |
| 2,931,210 | 4/1960 | Agee | 70/456 R |
| 3,315,505 | 4/1967 | Shelton | 70/456 R |
| 3,354,678 | 11/1967 | Stifelman | 150/40 X |
| 3,457,746 | 7/1969 | Glassman | 70/456 R |
| 3,672,192 | 6/1972 | Dontas | 70/456 R X |
| 3,765,200 | 10/1973 | Vogt | 70/456 R |

*Primary Examiner*—Donald F. Norton
*Attorney, Agent, or Firm*—Ladas & Parry

[57] ABSTRACT

A receptacle for a key comprises a casing defining an interior space for receiving a key. The casing is formed at one end with an opening through which the key can be introduced into the interior space, with its operating portion first, and at its opposite end with an opening large enough to allow the operating portion of the key to project therethrough while the gripping portion of the key remains in the interior space. The casing has a main face which is formed with a slot-form opening extending substantially the entire distance between the opposite ends of the casing. The receptacle also comprises a key push member which can be fitted in the slot so that it engages the gripping portion of the key in the interior space but has a part which is disposed to be manually accessible from outside the casing, whereby the key push member can be actuated manually to slide the key in the interior space between a retracted position, in which the key lies substantially wholly within the interior space, and a projecting position, in which the operating portion of the key projects from the casing.

4 Claims, 4 Drawing Figures

RECEPTACLES FOR KEYS

This invention relates to receptacles for keys.

According to the present invention there is provided a receptacle for a key, comprising a generally parallelepipedal casing defining an interior space for receiving a key having an operating portion and a gripping portion, said casing having first and second opposite ends and being formed at said first end with an opening through which said key can be introduced into said interior space, with the operating portion first, and at said second end with an opening large enough to allow said operating portion of the key to project therethrough while said gripping portion remains in said interior space, and said casing also having first and second opposite edges and first and second opposite main faces, said first main face being formed with a slot-form opening extending substantially the entire distance between said first and second opposite ends, and the receptacle also comprising a key push member which has a first part and a second part and which can be fitted in said slot so that its first part engages the gripping portion of the key in said interior space and its second part is disposed to be manually accessible from outside said casing, whereby the second part of the key push member can be actuated manually to slide the key in the interior space between a retracted position, in which the key lies substantially wholly within said interior space and said key push member is near said first end of the casing, and a projecting position, in which the operating portion of the key projects through the opening at said second end of the casing and said key push member is near said second end of the casing.

For a better understanding of the invention, and to show how the same may be carried into effect, reference will now be made, by way of example, to the accompanying drawing in which.

Figure 1:
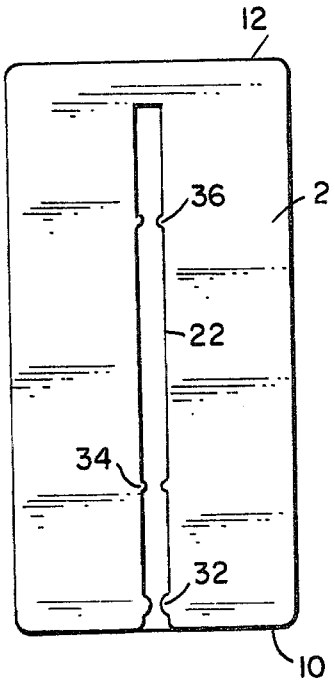
FIG. 1 is a top plan view of a key slide.

The key slide comprises an injection-molded plastic casing having top and bottom walls 2 and 4 and side walls 6 and 8, and defining openings at the two ends 10 and 12. The walls 2, 4, 6 and 8 define an interior space, which is divided by a partition 16 into two compartments 18 and 20. Each of the walls 2 and 4 is formed with a slot 22,24 extending centrally along the walls 2 and 4, parallel to the walls 6 and 8. The slot is open at the end 10 of the casing, but terminates short of the other end. Each of the slots is provided with three pairs of opposed retainers 32, 34 and 36. Respective key push members 26,28 (not shown in FIG. 1) are fitted in the slots 22,24. Each key push member comprises a shank *26a*,*28a* which extends within the slot, an actuating part *26b*,*28b* which is disposed outside the casing, a retaining part *26c*, *28c* which is disposed inside the casing and a projecting pin *26d*,*28d*, also disposed inside the casing. The key push members are fitted in the respective slots by sliding them in from the end 10, pushing them past the retainers 32. When, for example, the key push member 26 is fitted in the slot 22, the pin *26d* extends almost the entire distance across the compartment 18 to the partition 16, and the retaining part *26c* runs in a channel 30 at the interior side of the wall 2.

Each of the compartments 18 and 20 is dimensioned to receive a single key of the type commonly employed in a pin tumbler cylinder lock, such as a Yale type lock or similar.

In order to fit a key into an empty compartment, for example the compartment 18, the key push member 26 is removed from the slot 22, by pulling it past the retainers 32. The key is then introduced into the compartment through the opening at the end 10, with the operating portion of the key first, until the hole in the gripping portion of the key, normally provided for fitting the key on a key ring, is about to enter the compartment. At this point, the pin *26d* of the key push member is fitted in the hole, and the key is pushed home into the compartment and the shank *26a* of the key push member is fitted in the slot 22 and pushed past the retainers 32. Then, in order to use the key, the key push member is advanced along the slot 22 towards the end 12, past the retainers 34 and 36, so that the pin *26d* advances the key and the operating portion of the key projects from the opening at the end 12 of the casing. The key is held in the projecting position by the retainers 36. Similarly, when the key is no longer needed, by retracting the key push member towards the end 10, past the retainers 36 and 34, the operating portion of the key is retracted into the casing, and the key is held in the retracted position by the retainers 34.

Figure 2:
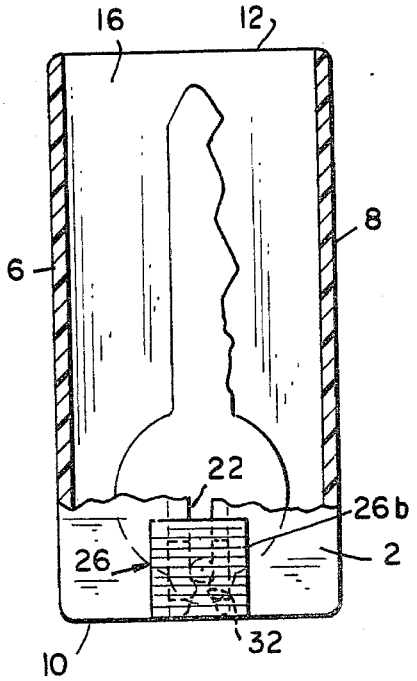
FIG. 2 is a top plan view of the key slide, partly cut away.
Figure 3:
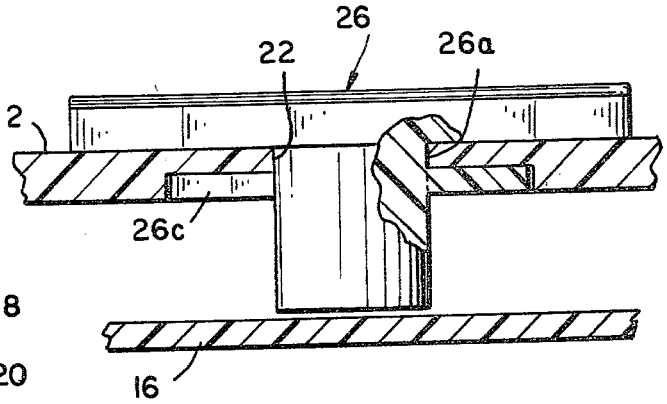
FIG. 3 is an enlarged view, partly in section, of part of the key slide.
Figure 4:
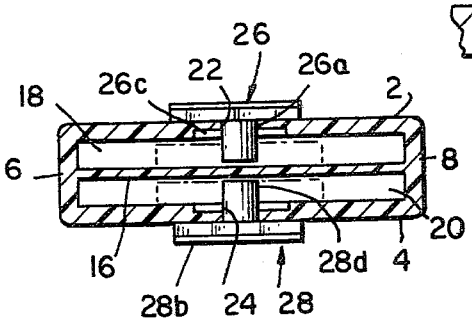
FIG. 4 is a cross-sectional view of the key slide.

The actuating parts *26b*,*28b* of the key push members are formed with ridges (shown in FIG. 2) in order to facilitate sliding of the key push members along the respective slots.

It will, of course, be appreciated that the key slide is capable of accommodating two keys, in the two compartments 18 and 20 respectively.

The invention is not limited to the particular key slide which has been shown and described, since it will be apparent to those skilled in the art that changes may be made without departing from the scope of the invention as defined in the appended claims.

I claim:

1. A receptacle for a key, comprising a generally parallelepipedal casing defining an interior space for receiving a key having an operating portion and a gripping portion, which gripping portion is formed with a hole for attaching the key removably to a retaining device, said casing having first and second opposite ends and being formed at said first end with an opening through which said key can be introduced into said interior space, with the operating portion first, and at said second end with an opening large enough to allow said operating portion of the key to project therethrough while said gripping portion remains in said interior space, and said casing also having first and second opposite edges and first and second opposite main faces, said first main face being formed with a slot which is open to said first end of the casing and extends substantially the entire distance towards said second end of the casing, and the receptacle also comprising a key push member which has first, second and third parts and which can be fitted in said slot by way of the open end thereof with its first part extending into the hole of the gripping portion of the key in said interior space, its second part located within said slot and its third part disposed to be manually accessible from outside said casing, whereby the third part of the key push member can be actuated manually to slide the key in the interior space between a retracted position, in which the key lies substantially wholly within said interior space and said key push member is near said first end of the casing, and a projecting position, in which the operating portion of the key projects through the opening at said second end of the casing, at least part of the gripping portion of the key is inside the casing and said key push member is near said second end of the casing, and the first main face of the casing being formed with a pair of projections defining a narrow part of the slot near the first end of the casing to engage the second part of the key push member when it has been fitted in the slot and is urged away from the second end of the casing, to prevent accidental removal of the key push member from the slot, said first part of the key push member manually removable from the hole of the gripping portion of the key, to permit use of the receptacle with a different key, and having a portion which is enlarged with respect to the second part of the key push member to prevent removal of the key push member from the slot except by way of the open end thereof.

2. A receptacle as claimed in claim 1, wherein said interior space is divided into first and second compartments by means of a stationary, essentially rigid partition extending therewithin and secured to the casing along the interiors of the first and second edges, each of said compartments being adapted to receive a key, and said key push member, in use, is disposed with its first part extending removably into the hole of the gripping portion of a key in said first compartment, said second main face being formed with a slot which is open to said first end of the casing and extends substantially the entire distance towards said second end of the casing, and the receptacle also comprising a second key push member which has first, second and third parts and which can be fitted in the slot of said second main face by way of the open end thereof with its first part extending into the hole of the gripping portion of a key in said second compartment, its second part located within the slot and its third part disposed to be manually accessible from outside said casing, whereby the third part of the second key push member can be actuated manually to slide the key in the second compartment between a retracted position, in which the key lies substantially wholly within said second compartment and said second key push member is near said first end of the casing, and a projecting position, in which the operating portion of the key in the second compartment projects through the opening at said second end of the casing and said second key push member is near said second end of the casing, the first part of the second key push member being manually removable from the hole of the gripping portion of the key in the second compartment, to permit use of the receptacle with a different key in the second compartment, and having a portion which is enlarged with respect to the second part of the second key push member to prevent removal of the second key push member from the second slot except by way of the open end thereof.

3. A receptacle as claimed in claim 1, wherein said first main face of the casing is formed with a second pair of projections defining a second narrow part of the slot spaced towards the second end of the casing from the first-mentioned narrow part of the slot to engage the second part of the key push member when it is fitted in the slot and is at the first end of the casing and is urged towards the second end of the casing, to resist unintended movement of the key push member towards the second end of the casing.

4. A receptacle as claimed in claim 1 or 3, wherein the first main face of the casing is formed with an additional pair of projections defining an additional narrow part of the slot spaced towards the first-mentioned narrow part of the slot from the second end of the casing to engage the second part of the key push member when it is fitted in the slot and is near the second end of the casing and is urged towards the first end of the casing, to resist unintended movement of the key push member towards the first end of the casing.

* * * * *